US007593677B2

(12) United States Patent
Shiozawa

(10) Patent No.: US 7,593,677 B2
(45) Date of Patent: Sep. 22, 2009

(54) IMAGE FORMING APPARATUS WITH DECREASED POTENTIAL DIFFERENCE BETWEEN A BELT MEMBER TRANSFER PORTION AND A BELT MEMBER BENDING PORTION

(75) Inventor: Motohide Shiozawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 11/624,941

(22) Filed: Jan. 19, 2007

(65) Prior Publication Data

US 2007/0172269 A1 Jul. 26, 2007

(30) Foreign Application Priority Data

Jan. 25, 2006 (JP) ..... 2006-015733

(51) Int. Cl.
*G03G 15/16* (2006.01)

(52) U.S. Cl. ..... 399/313; 399/314

(58) Field of Classification Search ..... 399/312, 399/302, 313, 314

See application file for complete search history.

(56) References Cited

U.S. PATENT DOCUMENTS 6,144,831 A * 11/2000 Takenouchi et al. ..... 399/302
6,381,428 B1 * 4/2002 Yamamoto et al. ..... 399/116
6,501,925 B2 12/2002 Yamamoto et al. ..... 399/116
6,697,586 B2 2/2004 Yamamoto et al. ..... 399/110
2006/0088342 A1 * 4/2006 Hamada et al. ..... 399/296
2006/0216082 A1 * 9/2006 Kojima ..... 399/350

FOREIGN PATENT DOCUMENTS

JP 8-146706 6/1996
JP 2001-134042 5/2001
JP 2003-241531 8/2003
JP 2003241531 A * 8/2003

* cited by examiner

*Primary Examiner*—David M Gray
*Assistant Examiner*—Billy J Lactaoen
(74) *Attorney, Agent, or Firm*—Fitzpatrick, Cella, Harper & Scinto

(57) ABSTRACT

An object of the present invention is to provide an image forming apparatus including a belt-shaped image bearing member; a first transfer member which abuts on the outer peripheral surface of the image bearing member; a second transfer member which abuts on an inner peripheral surface of the image bearing member; transfer electric field forming unit; a bending member which bends the image bearing member from the outer peripheral surface toward the inner peripheral surface on a downstream side of the transfer portion in a traveling direction of the image bearing member; a conductive member in which an electric field is formed with the bending member; and voltage applying unit which applies a voltage having a polarity opposite to the toner to the conductive member.

14 Claims, 7 Drawing Sheets

IMAGE FORMING APPARATUS WITH DECREASED POTENTIAL DIFFERENCE BETWEEN A BELT MEMBER TRANSFER PORTION AND A BELT MEMBER BENDING PORTION

BACKGROUND OF THE INVENTION

1. Field of the Invention

The present invention relates to an image forming apparatus in which a developer image borne by a belt is transferred to a recording material, particularly to the image forming apparatus in which a developer hardly adheres to a bending member when the bending member abuts on a developer image bearing surface side of the belt.

2. Description of the Related Art

Recently, in a copying machine and a printer in which electrophotographic technology is utilized, a configuration in which the belt conveying a developer image is used is frequently adopted because the configuration has advantages such as a high degree of freedom of arrangement and high flexibility to various media.

For the configuration in which the high degree of freedom of arrangement is utilized, the configuration in which a roller is arranged inside the belt and the bending member including another roller presses a surface side of the belt is increasingly adopted.

The use of the bending member can decrease an excessive space inside the belt as much as possible, and thereby the space of the whole apparatus body can be decreased.

Because the bending member abuts on the developer transfer surface side of the belt, a developer is easy to adhere to the bending member. Therefore, for example, Japanese Patent Application Laid-Open No. 8-146706 proposes that the developer is prevented from adhering to the bending member by applying a bias having the same polarity as the polarity of the developer on the belt to the bending member. However, in applying the voltage having the same polarity as the polarity of the developer to the bending member, the voltage applied to the bending member differs from the transfer voltage in polarity, when a transfer voltage having the polarity opposite to the developer from a recording material backside in a transfer portion. Therefore, a potential difference is increased between the bending member and the transfer portion, which results in a risk of generating electrical interference depending on a resistance of an intermediate transfer member.

For example, in the case where the image is formed using a negatively charged developer, the transfer voltage having the positive polarity opposite to the developer is applied from a recording medium backside to a first transfer member, and the transfer is performed by passing a current between the first transfer member and the grounded second transfer member. The developer is prevented from adhering to the bending member by applying the voltage having the same negative polarity as the developer to the bending member which bends the belt.

At this point, the large potential difference between the transfer portion and the bending member causes a part of the transfer current to be easily passed in the bending member direction, which relatively decreases the current passed in the first transfer member direction. Experience shows that the transfer current strays from an optimum value to cause defective transfer unless the decrease in transfer current is suppressed to 5% or less, preferably to 3% or less.

SUMMARY OF THE INVENTION

In view of the foregoing, an object of the invention is to provide an image forming apparatus wherein the electrical interference can be decreased to stably transfer the developer image to the recording material by decreasing a potential difference between the transfer portion and the bending member which is in contact with the belt surface.

Another object of the present invention is to provide an image forming apparatus including a belt-shaped image bearing member which travels while bearing a toner image including charged toners on an outer peripheral surface thereof;

a first transfer member which abuts on the outer peripheral surface of the image bearing member;

a second transfer member which abuts on an inner peripheral surface of the image bearing member, the second transfer member nipping the image bearing member with the first transfer member and forming a transfer portion where the toner image is transferred to a recording material;

a transfer electric field forming unit which applies a voltage having a polarity opposite to the toner to the first transfer member to form an electric field in the transfer portion, the toner being moved from the image bearing member toward the recording material in the electric field;

a bending member which bends the image bearing member from the outer peripheral surface toward the inner peripheral surface on a downstream side of the transfer portion in a traveling direction of the image bearing member;

a conductive member which forms an electric field between the bending member and the conductive member; and a voltage applying unit which applies a voltage having a polarity opposite to the toner to the conductive member.

Still another object of the present invention is to provide an image forming apparatus including a belt-shaped image bearing member which travels while bearing a toner image including charged toners on an outer peripheral surface thereof;

a first transfer member which abuts on the outer peripheral surface of the image bearing member;

a second transfer member which abuts on an inner peripheral surface of the image bearing member, the second transfer member nipping the image bearing member with the first transfer member and forming a transfer portion where the toner image is transferred to a recording material;

a transfer electric field forming unit which applies a voltage having the same polarity as the toner to the second transfer member to form an electric field in the transfer portion, the toner being moved from the image bearing member toward the recording material in the electric field;

a bending member which bends the image bearing member from the outer peripheral surface toward the inner peripheral surface on a downstream side of the transfer portion in a traveling direction of the image bearing member;

a conductive member which forms an electric field between the bending member and the conductive member; and a voltage applying unit which applies a voltage having the same polarity as the toner to the bending member.

DETAILED DESCRIPTION OF EXEMPLARY EMBODIMENTS

An image forming apparatus according to a first embodiment of the invention will be described below with reference to the drawings.

(Whole Configuration of an Image Forming Apparatus)

A whole configuration and an image forming operation of the image forming apparatus of the first embodiment will be described with reference to FIG. 1. In the image forming apparatus according to the first embodiment, a color image is formed through an electrophotographic process.

Figure 1:
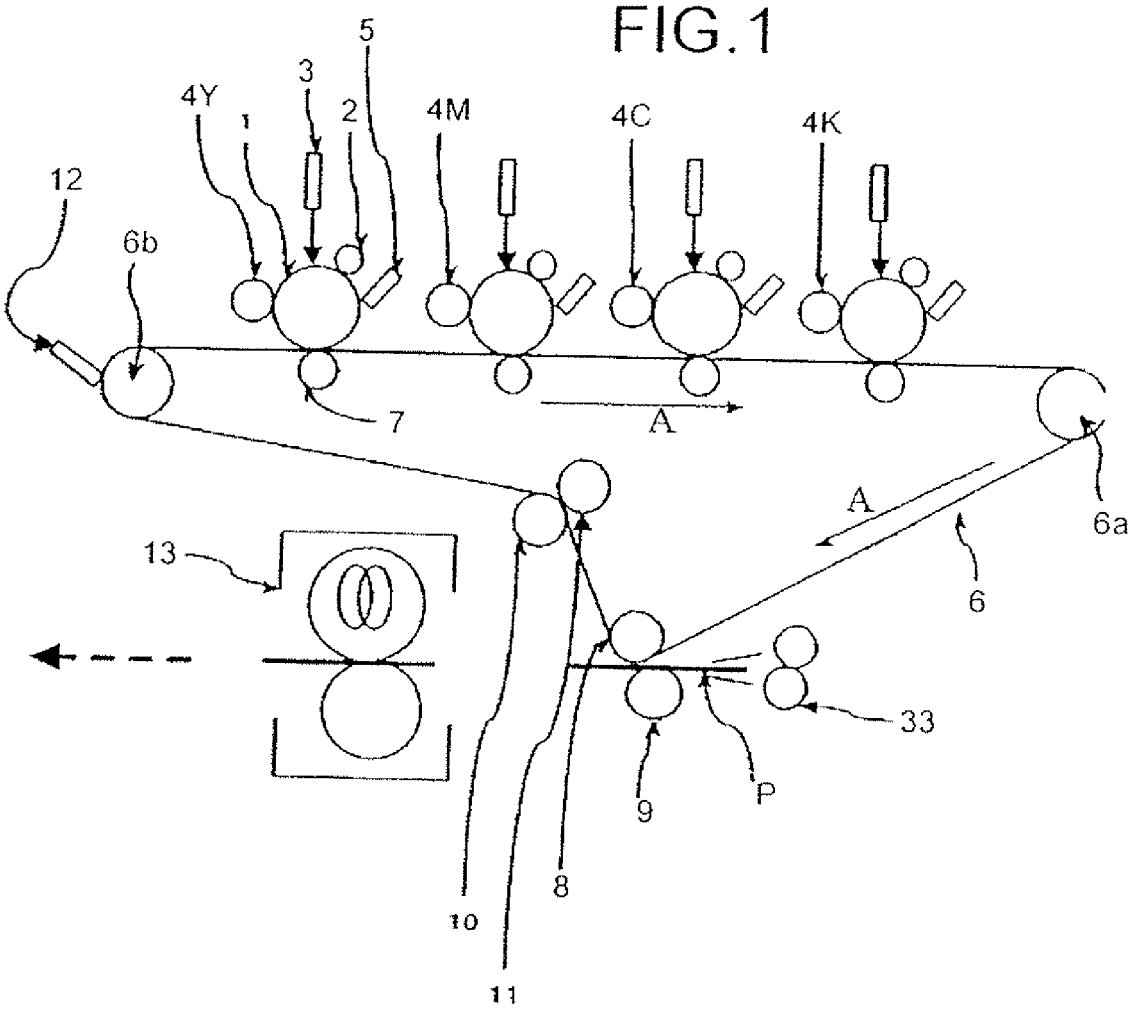
FIG. 1 is a sectional view illustrating an image forming portion.

In image forming unit, four image forming stations are substantially horizontally arranged, and the image forming stations form color developer images of yellow Y, magenta M, cyan C, and black K from the left of FIG. 1. The image forming stations have the same configuration except that the developer colors differ from one another.

In each image forming station, a primary charging member 2, a scanner unit 3, a development device 4, and a cleaning device 5 are arranged around a photosensitive drum 1.

An intermediate transfer belt 6 which is of an intermediate transfer member (image bearing member) is rotatably provided to abut on the photosensitive drum 1. The intermediate transfer belt 6 is entrained about a driving roller 6*a*, a driven roller 6*b*, and a backup roller 8, which are driven by a motor (not shown). A primary transfer roller 7 is provided across the intermediate transfer belt 6 from the photosensitive drum 1. That is, the driving roller 6*a*, the driven roller 6*b*, and the backup roller 8 are in contact with an inner peripheral surface of the intermediate transfer belt 6 to support the intermediate transfer belt 6.

In forming an image, a surface of the photosensitive drum 1 rotated counterclockwise (direction of arrow A of FIG. 1) are evenly charged by the primary charging member 2, and an electrostatic latent image is formed by irradiating the surface of the photosensitive drum 1 with a laser beam which is emitted from the scanner unit 5 according to an image signal. Using the developer, the development device 3 develops the latent image to make a visible image.

The developer image is primary-transferred to the intermediate transfer belt 6 at a primary transfer portion by applying a bias to the primary transfer roller 7. The primary transfer portion is a nip portion between the intermediate transfer belt 6 and the primary transfer roller 7. The developer images of the yellow, magenta, cyan, and black colors formed by the image forming stations are transferred to the intermediate transfer belt 6 while superposed on one another, which allows the color image to be formed. The color image is secondary-transferred to a recording medium (recording material) P to record the image at a secondary transfer portion by applying the bias to a secondary transfer roller (first transfer member) 9. The secondary transfer portion is a nip portion between the intermediate transfer belt 6 and the secondary transfer roller 9. The recording medium P is conveyed in synchronization with the image formation by the registration roller pair 33.

The recording medium to which the developer image is already transferred is guided to a fixing device 13, and heat and pressure are applied to the recording medium to fix the developer image to the recording medium P. Then, the recording medium is discharged to the outside of the apparatus.

On the other hand, the surface of the intermediate transfer belt 6 in which the developer image is already transferred to the recording medium P is cleaned with an intermediate transfer member cleaning device 12. In the intermediate transfer member cleaning device 12, secondary-transfer residual developer is mechanically removed and collected by causing a urethane-rubber blade to abut on the surface of the intermediate transfer belt 6. Alternatively, a method of causing a blade made of another material, a brush, or a roller to abut on the surface of the intermediate transfer belt 6 may be adopted, and a combination of these tools may be adopted. Electrostatic cleaning coupled with a cleaning bias may also be adopted.

In the image forming apparatus of the first embodiment, in a belt rotating direction (traveling direction), an intermediate transfer member bending unit is provided on a downstream side of the secondary transfer portion and on an upstream side of the intermediate transfer member cleaning device 12. In the intermediate transfer member bending unit, a reverse bending roller (bending member) 10, which is a bending member, abuts on the surface side of the intermediate transfer belt 6 to bend the intermediate transfer belt 6 toward an opposite direction (toward the inner peripheral surface from the outer peripheral surface) to a direction in which the intermediate transfer belt 6 is entrained about the driving roller 6*a*, the driven roller 6*b*, and the backup roller (second transfer member) 8. The urging power of the reverse bending roller 10 bends the intermediate transfer belt 6, which allows a rotating space of the intermediate transfer belt 6 to be decreased in the apparatus. In the first embodiment, the fixing device 13 is arranged in the space where the intermediate transfer belt 6 is bent by the reverse bending roller 10.

As described later, a bias is applied to the intermediate transfer member bending unit such that the transfer residual developer on the intermediate transfer belt 6 is prevented from adhering to the reverse bending roller 10.

(Biases at Secondary Transfer Portion and Intermediate Transfer Member Bending Unit)

In the configuration of the image forming apparatus of the first embodiment, the bias is applied to the intermediate transfer member bending unit (bending member) such that the developer is prevented from adhering to the reverse bending roller 10, which abuts on the belt surface side, and which is the developer adhering surface side of the intermediate transfer belt 6. Next, a relationship between the bias application in the intermediate transfer member bending unit and the transfer bias application in the secondary transfer portion will be described.

In the first embodiment, each color developer stored in the development device 4 is a two-component developer including a negatively-charged toner and a carrier. The two-component developers including the toners such as a crushing-type toner, a polymerization type toner, and a toner in which a toner parting agent is internally added, a one-component developer in which the carrier is not used, and a magnetic toner can be adopted. The different-color developers having the different types may be combined.

In the intermediate transfer belt 6 of the first embodiment, a polyimide resin having a thickness of 100 μm is used as a support body formed in a belt shape, by adjusting its electrical resistance. A urethane rubber having a thickness of 150 μm is provided as an elastic layer on the surface of the polyimide resin, and an acryl resin is coated as a toner parting layer for a developer cleaning property on the uppermost surface.

In addition, materials such as polyamide, polycarbonate, PET, PVDF, PTFE, and ETFE having certain strength can be selected as the support body of the intermediate transfer belt 6 as long as the materials can be formed in the belt shape having a thickness between tens micrometers and about hundred micrometers. Although the elastic layer is not necessarily formed, known elastic materials such as CR, NBR, EPDM, epichlorohydrin, SBR, a silicone rubber, and a fluorocarbon rubber can be adopted in order to improve a secondary transfer property for the recording sheet whose surface is not smooth. In the use of the support body or the elastic layer, when the elastic layer has the sufficient strength while the surface of the elastic layer is smooth and has the toner parting property, it is not necessary to provide the toner parting layer. When the elastic layer do not have sufficient strength, the toner parting layer can be provided. Fluorocarbon resins such as PTFE, PFA, and PVdF and silicone resins can be used as the toner parting layer.

In applying the bias to the intermediate transfer belt 6, when the belt has a high electrical resistance, charge-up is generated due to transfer charge, which results in risks of developer image splash, defective transfer, and defective cleaning. Therefore, a charge removal unit of the intermediate transfer belt 6 is required.

Image quality is evaluated by applying a secondary transfer bias using different electrical resistances of the intermediate transfer belts 6. As a result of the evaluation, in the case of the use of the intermediate transfer belt 6 having a volume resistivity of $1\times10^{13}$ Ω·cm or less and a surface resistivity of $1\times10^{15}$ Ω/□ or less, the charge-up caused by the transfer charge is hardly generated, which allows few defective transfers to be generated.

When the volume resistivity and surface resistivity of the intermediate transfer belt 6 are excessively decreased, the developer image cannot electrostatically be borne, which generates a risk of the developer image splash. Therefore, preferably the intermediate transfer belt 6 has an electrical resistance above a certain level. As a result of experiments, the above-described disadvantages are not generated in the case of the use of the intermediate transfer belt 6 having a volume resistivity of $1\times10^{5}$ Ω·cm or more and a surface resistivity of $1\times10^{7}$ Ω/□ or more.

Accordingly, the intermediate transfer belt 6 having a volume resistivity ranging from $1\times10^{5}$ Ω·cm to $1\times10^{13}$ Ω·cm and a surface resistivity ranging from $1\times10^{7}$ Ω/□ to $1\times10^{15}$ Ω/□ can be used.

Using the intermediate transfer belt in which the main electrode has an outer diameter of ϕ50 mm and a guard electrode has an inner diameter of ϕ70 mm, the resistivity is measured in compliance with JIS K6911 in an environment of 23° C. and 50% by an ultra-high resistance meter R8340 (manufactured by Advantest Corporation). With reference to the measurement conditions, an applied voltage is 100V and a charging time is 60 seconds.

In the first embodiment, based on the resistivity measurement, a silicone rubber layer having a thickness of 100 μm is provided on polyimide having a thickness of 80 μm, the surface of the silicone rubber layer is coated with PFA in the whole thickness of 200 μm, and the volume resistivity is set to $5\times10^{8}$ Ω·cm while the surface resistivity is set to $1\times10^{11}$ Ω/□.

The secondary transfer portion includes the secondary transfer roller 9 and the backup roller 8. The secondary transfer roller 9, which is of the first transfer member, abuts on the belt surface side which is of the developer image transfer surface side of the intermediate transfer belt 6. The backup roller 8, which is of the second transfer member, abuts on the backside of the intermediate transfer belt 6 while facing the secondary transfer roller 9 through the intermediate transfer belt 6.

A solid rubber roller may be used as the secondary transfer roller 9. However, in order to secure a nip region at a secondary transfer nip, preferably a sponge roller such as urethane and EPDM in which the electrical resistance is adjusted is used as the secondary transfer roller 9. A toner parting layer may be provided on the surface in order that the developer is prevented from adhering to the roller surface or in order that the cleaning property is secured on the roller surface. The urethane sponge roller having an electrical resistance of $5\times10^{7}$Ω is adopted in the first embodiment.

The hard roller having a small deformation is suitable to the backup roller 8 because the backup roller 8 supports the intermediate transfer belt 6. A metal roller made of aluminum, stainless steel, or the solid rubber roller whose electrical resistance is adjusted is used as the backup roller 8. In the first embodiment, an EPDM roller having the electrical resistance of $1\times10^{5}$Ω is used as the backup roller 8.

For the electrical resistance measurement of the roller member, the roller is rotated while abutting on a grounded metal roller with a load of 500 g, and the electrical resistance is computed from a current measured in applying a voltage to a core of the metal roller.

The hard roller can be used as the reverse bending roller 10 constituting the intermediate transfer member bending unit in order that tension of the intermediate transfer belt 6 is stabilized while the intermediate transfer belt 6 is pushed into. The metal roller made of aluminum, stainless steel, and the solid rubber roller whose resistance is adjusted are used as the reverse bending roller 10. The toner parting layer may be provided in order that the developer hardly adheres to the surface of the reverse bending roller 10. The reverse bending roller 10 in which fluorine coating is performed to the surface of EPDM rubber to obtain an electrical resistance of 5×10 Ω is used in the first embodiment.

As with the secondary transfer roller 9 and the reverse bending roller 10, both the hard roller and the elastic roller are used as the electrode roller 11 which is of the counter electrode member (conductive member) facing the reverse bending roller 10 through the intermediate transfer belt 6. The same material as the backup roller 8 is used as the electrode roller 11.

Preferably a position at which the electrode roller 11 abuts on the intermediate transfer belt 6 is set within the nip region between the reverse bending roller 10 and the intermediate transfer belt 6. The abutting position of the electrode roller 11 on the intermediate transfer belt 6 is located out of the nip region between the reverse bending roller 10 and the intermediate transfer belt 6, which results in a risk of generating discharge of a developer adhesion preventing bias at a gap near the nip region between the intermediate transfer belt 6 and the reverse bending roller 10. Therefore, there is a possibility of reversing a charge polarity of the developer passing through the discharge region. When the polarity of the developer is reversed, the developer adhesion preventing bias possibly causes the developer to adhere to the reverse bending roller 10, or the developer image is possibly disturbed when passing before the secondary transfer portion.

On the contrary, when the electrode roller 11 abuts on the backside of the intermediate transfer belt 6 within the nip region where the intermediate transfer belt 6 and the reverse bending roller 10 are in close contact with each other, the charge polarity of the developer is not reversed because the discharge is not generated.

Figure 2:
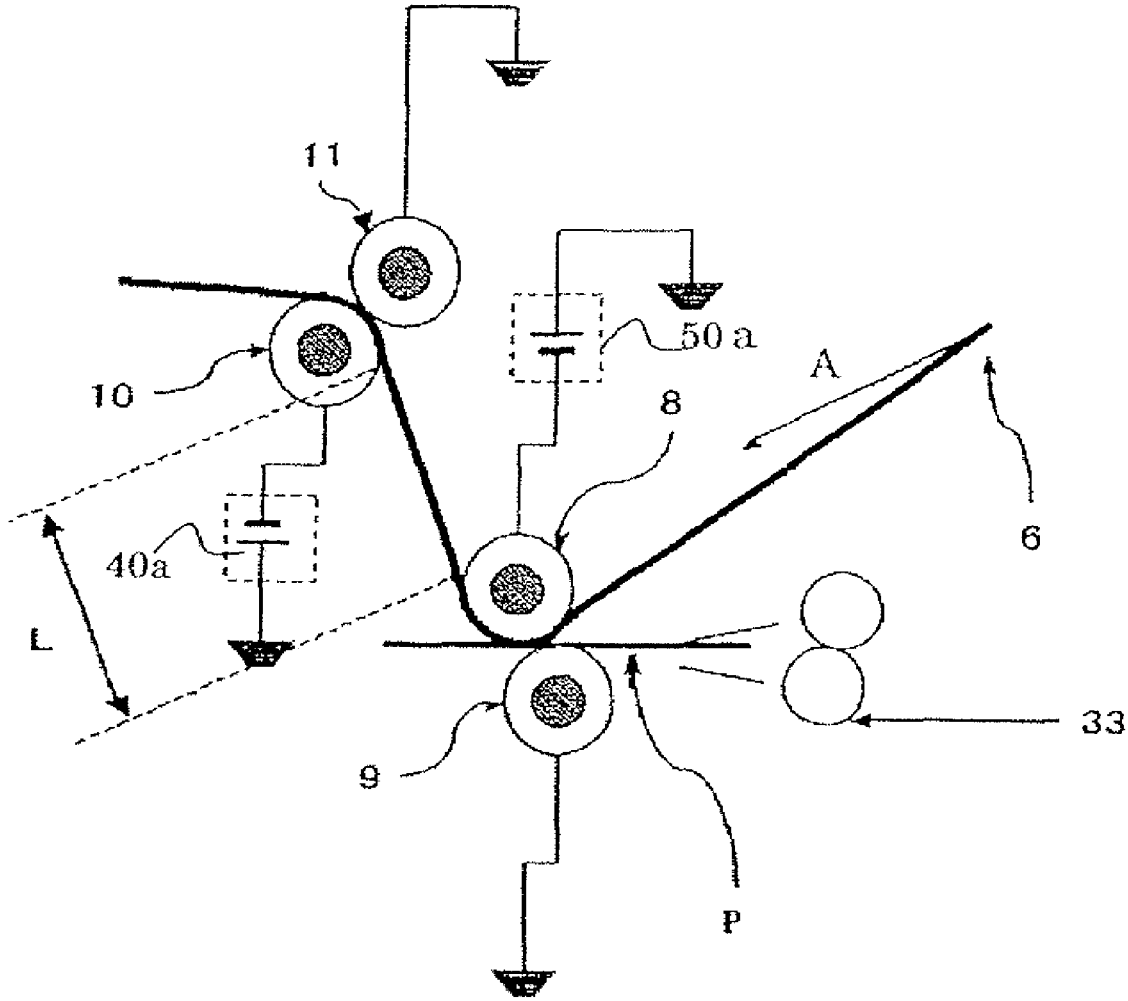
FIG. 2 is an explanatory view of a first embodiment of the invention.

As illustrated in FIG. 2, the intermediate transfer belt 6 is not supported by the roller in an interval L between the secondary transfer portion and the reverse bending portion (reverse bending region) in the belt rotating direction. The secondary transfer portion is the abutting portion of the intermediate transfer belt 6 and the secondary transfer roller 9, and the reverse bending portion is the abutting portion of the intermediate transfer belt 6 and the reverse bending roller 10. In the not-supported interval L, assuming that the intermediate transfer belt 6 is not changed in an electrical resistance, the influence of electrical interference can be decreased as the interval L is increased. However, when the interval L is excessively increased, the total length of the intermediate transfer belt 6 is excessively lengthened, which contravenes the original purpose of which the space in the apparatus is effectively utilized by reversely bending the intermediate transfer belt 6. Accordingly, preferably the interval L is shortened and the intermediate transfer member bending unit is arranged near the secondary transfer portion in order to downsize the whole of the apparatus.

Figure 6:
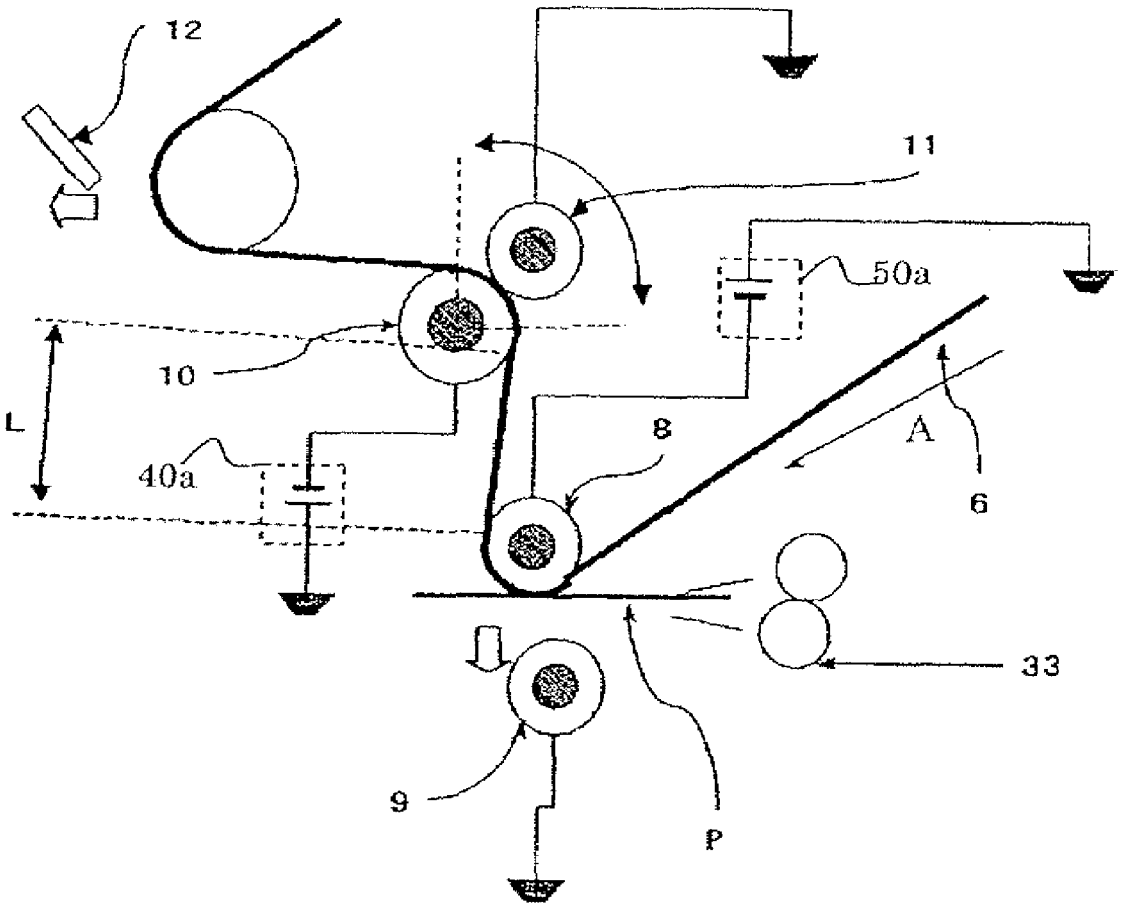
FIG. 6 is an explanatory view of the third embodiment.

For example, preferably the interval L is set to 200 mm or less when the fixing device 13 is arranged in the space secured by reversely bending the intermediate transfer belt 6 as illustrated in FIG. 2. As illustrated in FIG. 6, preferably the interval L is set to about 30 mm when the intermediate transfer belt 6 is separated away from the heat of the fixing device 13.

When the interval L is longer than 200 mm, the influence of the electrical interference is decreased between the secondary transfer portion and the intermediate transfer member bending unit although the apparatus is enlarged. Accordingly, in the first embodiment, the compact apparatus having the interval L not more than 200 mm is formed to decrease the electrical interference by applying the bias at the reverse bending portion as described later.

The bias application for the purpose of the image formation in the first embodiment will be described below. A process speed of the image forming portion is set at 200 mm/s in the first embodiment. The surface of the photosensitive drum 1 is evenly charged to −600V by applying a negative bias to the primary charging member 2, the exposure member 3 performs the selective exposure according to the image signal to the photosensitive member. And the exposed portion on the surface is decreased to −150V to form an electrostatic latent image. Then, the development device 4 applies a development bias of −350V DC bias to the latent image in addition to an AC bias, and the development is performed to visualize the latent image with the developer. The transfer bias of +200V is applied to the primary transfer roller 7 to transfer the developer image onto the intermediate transfer belt 6. The images are transferred for the colors of yellow, magenta, cyan, and black while the images are positioned, which allows the multi-color image to be formed on the surface of the intermediate transfer belt 6.

Then, the image is secondary-transferred from the intermediate transfer belt 6 to the recording medium P, and the intermediate transfer belt 6 passes through the reverse bending roller 10 while several-percent of not-transferred residual developer adheres to the intermediate transfer belt 6. Therefore, the developer adhesion preventing bias is applied to the nip portion of the reverse bending roller 10, and thereby the transfer residual developer on the intermediate transfer belt 6 is prevented from adhering to the reverse bending roller 10.

At this point, in the first embodiment, a bias having the same polarity as a voltage applied to the secondary transfer portion is applied to the reverse bending roller 10.

(Polarity of Applied Bias)

The polarity of the bias application will specifically be described. In the image forming apparatus of the first embodiment, the interval L illustrated in FIG. 2 is set to 200 mm. The intermediate transfer belt has a thickness of 200 μm and a volume resistivity of $5\times10^{8}\Omega\cdot$cm. Therefore, the secondary transfer portion has an electrical resistance of about $1\times10^{7}\Omega$ in the thickness direction, and the intermediate transfer belt 6 in the range of the secondary transfer portion to the reverse bending portion has an electrical resistance of about $2.1\times10^{10}\Omega$ which is 1000 times the electrical resistance in the belt thickness direction.

In the secondary transfer portion, the transfer bias of −1500V is applied to the backup roller 8 by connecting a backup roller power supply (transfer electric field forming unit) 50*a* which applies the negative high voltage having the same polarity as the developer charge polarity, and the secondary transfer roller 9 is grounded.

When an extremely large secondary transfer bias is applied, sometimes the developer polarity is reversed. However, when a secondary transfer bias is applied within a usual value range like the first embodiment, the developer polarity is hardly reversed in the secondary transfer portion. Accordingly, in the first embodiment, the secondary transfer residual developer on the intermediate transfer belt 6 also has the negative polarity after the secondary transfer.

Therefore, in the reverse bending portion, a reverse bending roller power supply (voltage applying unit) 40*a* which applies the negative high voltage having the same polarity as the transfer bias is connected to the reverse bending roller 10, and the developer adhesion preventing bias of −1500V is applied to the reverse bending roller 10 while the electrode roller 11 is grounded.

In forming the image, the secondary transfer current of 22 μA is passed through the secondary transfer roller 9, and the current lower than 1 μA is passed through the electrode roller 11 via the intermediate transfer belt 6.

Thus, the negative bias having the same polarity as the transfer residual developer on the intermediate transfer belt 6 is applied to the reverse bending roller 10, which prevents the transfer residual developer from adhering to the reverse bending roller 10. A potential difference between the secondary transfer portion and the intermediate transfer member reverse bending portion is decreased by applying the bias having the same polarity as the polarity of the bias, applied to the secondary transfer portion, to the reverse bending roller 10. Therefore, the electrical interference is decreased between the secondary transfer portion and the intermediate transfer member reverse bending portion, while the secondary transfer current passed between the secondary transfer roller 9 and the backup roller 8 in the secondary transfer portion is not decreased too much. This enables the developer image to be stably transferred to the recording medium to stabilize the output image quality.

As described above, in the first embodiment, the electrical resistance of the intermediate transfer belt 6 in the interval L of the secondary transfer portion to the reverse bending portion is 1000 times the electrical resistance in the belt thickness direction. As a result of experiments, in the apparatus of the first embodiment, when the belt electrical resistance in the interval L becomes at least 2000 times the electrical resistance in the belt thickness direction, the electrical interference caused by the bias applied to the reverse bending portion has a little influence on the secondary transfer portion. Therefore, the use of the intermediate transfer belt 6 in which the belt electrical resistance in the interval L is 2000 times or less the electrical resistance in the belt thickness direction effectively decreases the electrical interference by applying the bias having the same polarity between the secondary transfer portion and the reverse bending portion.

COMPARATIVE EXAMPLE 1

Figure 3:
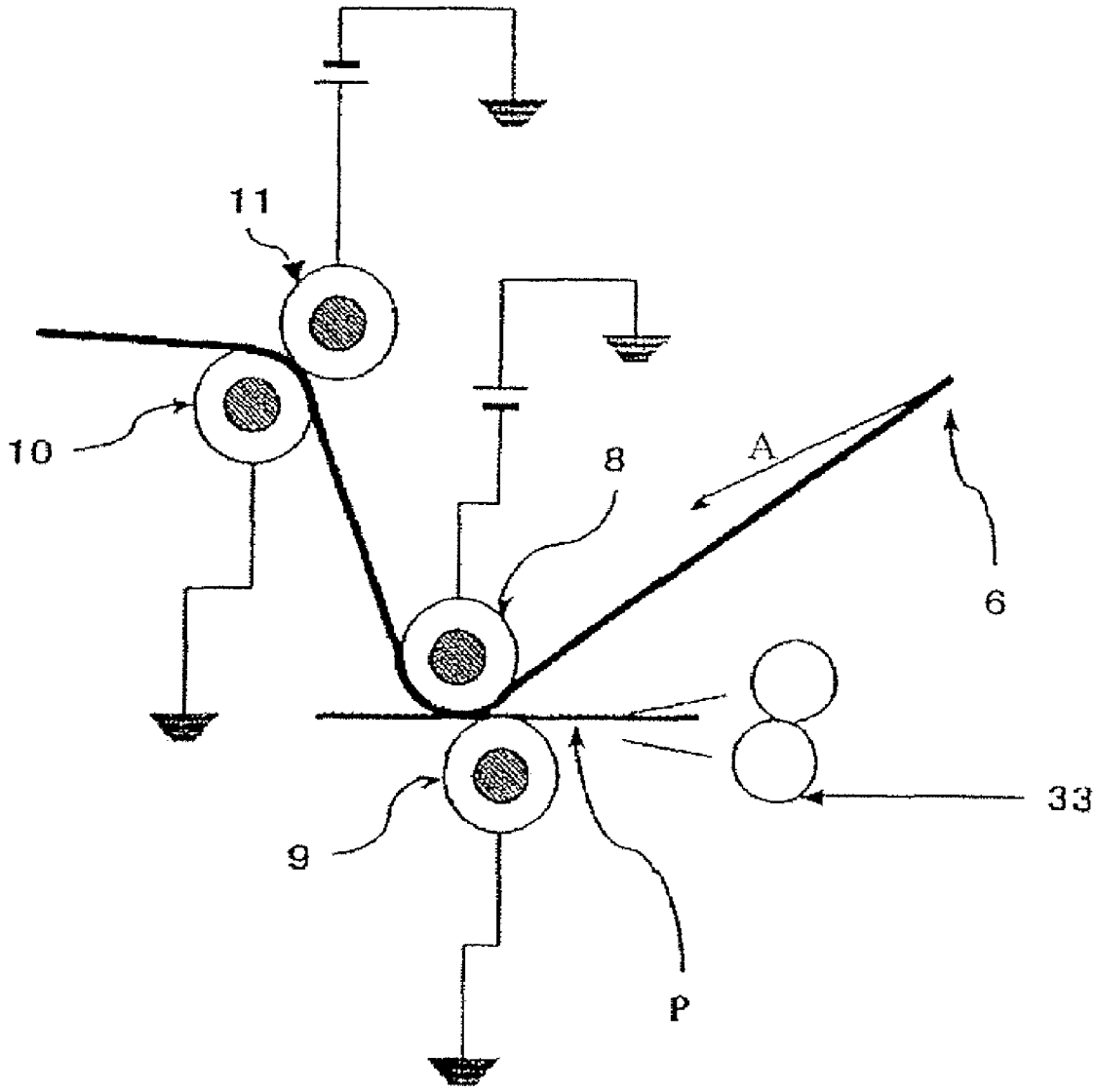
FIG. 3 is an explanatory view of a comparative example.

For a comparative example 1, as illustrated in FIG. 3, in the reverse bending portion, the reverse bending roller 10 is grounded, and the developer adhesion preventing bias of +1500V having a polarity opposite to a polarity of a bias at the secondary transfer portion is applied to the electrode roller 11. For the transfer bias conditions, as with the first embodiment, a power supply which applies the negative high voltage having the same polarity as the developer charge polarity is connected to the backup roller 8, and the transfer bias of −1500V is applied as the transfer bias to the backup roller 8 while the secondary transfer roller 9 is grounded. In this case, a current of 20 μA flows through the secondary transfer roller 9, and the current of about 2 μA is passed through the electrode roller 11 via the intermediate transfer belt 6.

Thus, when the bias having the polarity opposite to the secondary transfer portion is applied to the intermediate transfer member bending unit, the secondary transfer current is decreased, and the current passed from the secondary transfer portion to the intermediate transfer member bending unit is increased.

Second Embodiment

Figure 4:
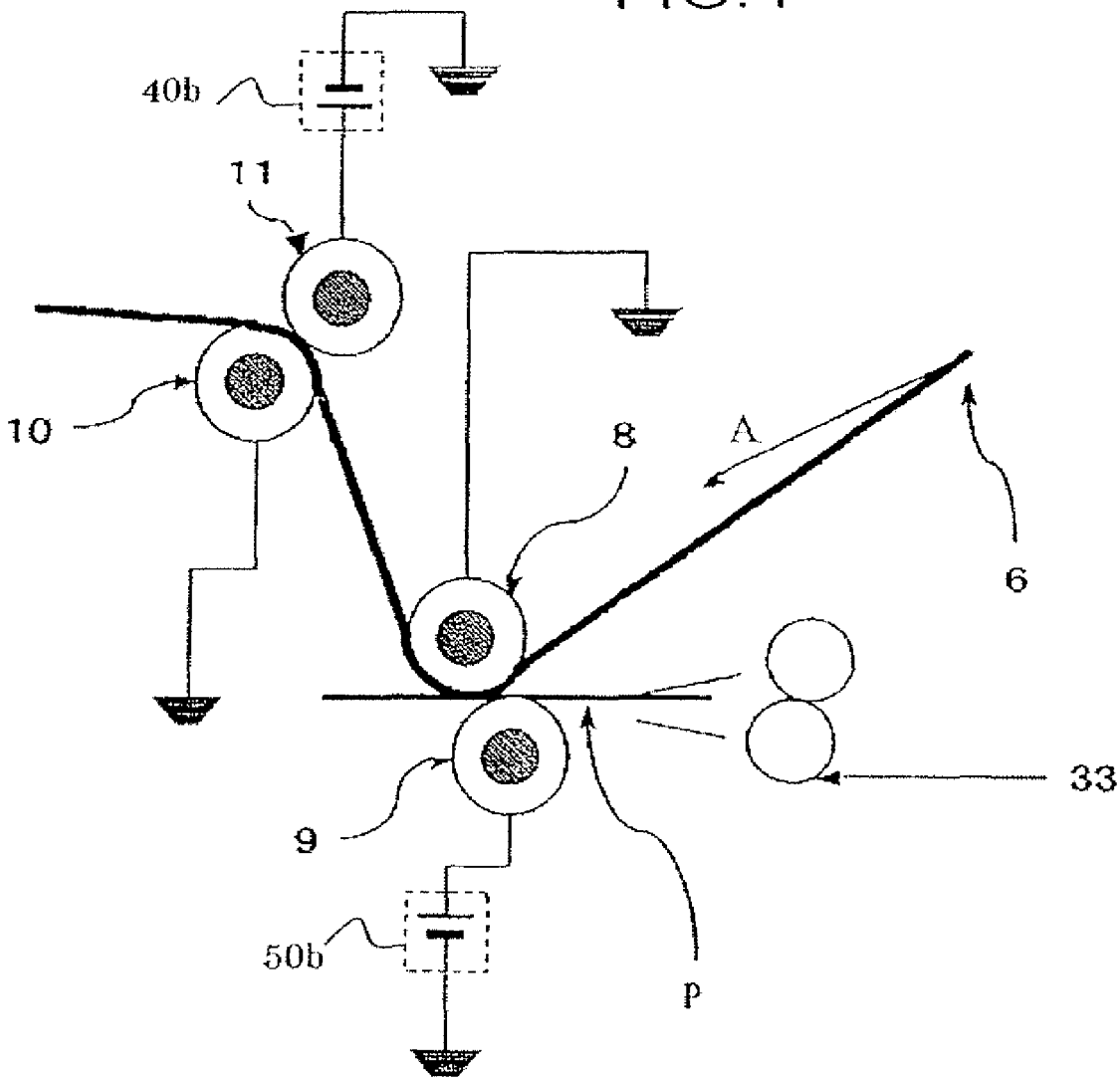
FIG. 4 is an explanatory view of a second embodiment of the invention.

An image forming apparatus according to a second embodiment of the invention will now be described below with reference to FIG. 4. Only the characteristic configuration of the image forming apparatus of the second embodiment will be described, and the overlapping description will not be repeated because the basic configuration of the second embodiment is similar to that of the first embodiment. In the second embodiment, the components having the same function as that of the first embodiment is designated by the same reference numerals and characters.

In the second embodiment, a secondary transfer roller power supply (transfer electric field forming unit) 50*b* which applies a positive high voltage having a polarity opposite to the developer charge polarity is applied as a transfer bias to the secondary transfer roller 9 is connected to the secondary transfer roller 9, and a transfer bias of +1500V is applied to the secondary transfer roller 9 while the backup roller 8 is grounded.

On the other hand, in the reverse bending portion, an electrode roller power supply (voltage applying unit) 40*b* which applies the positive high voltage having the same polarity as the transfer bias is connected to the electrode roller 11, and a developer adhesion preventing bias of +1500V is applied to the electrode roller 11 while the reverse bending roller 10 is grounded.

In the second embodiment, as with the first embodiment, the secondary transfer current of 22 μA flows through the secondary transfer roller 9, and a current lower than 1 μA flows through the electrode roller 11 via the intermediate transfer belt 6.

Third Embodiment

Figure 5:
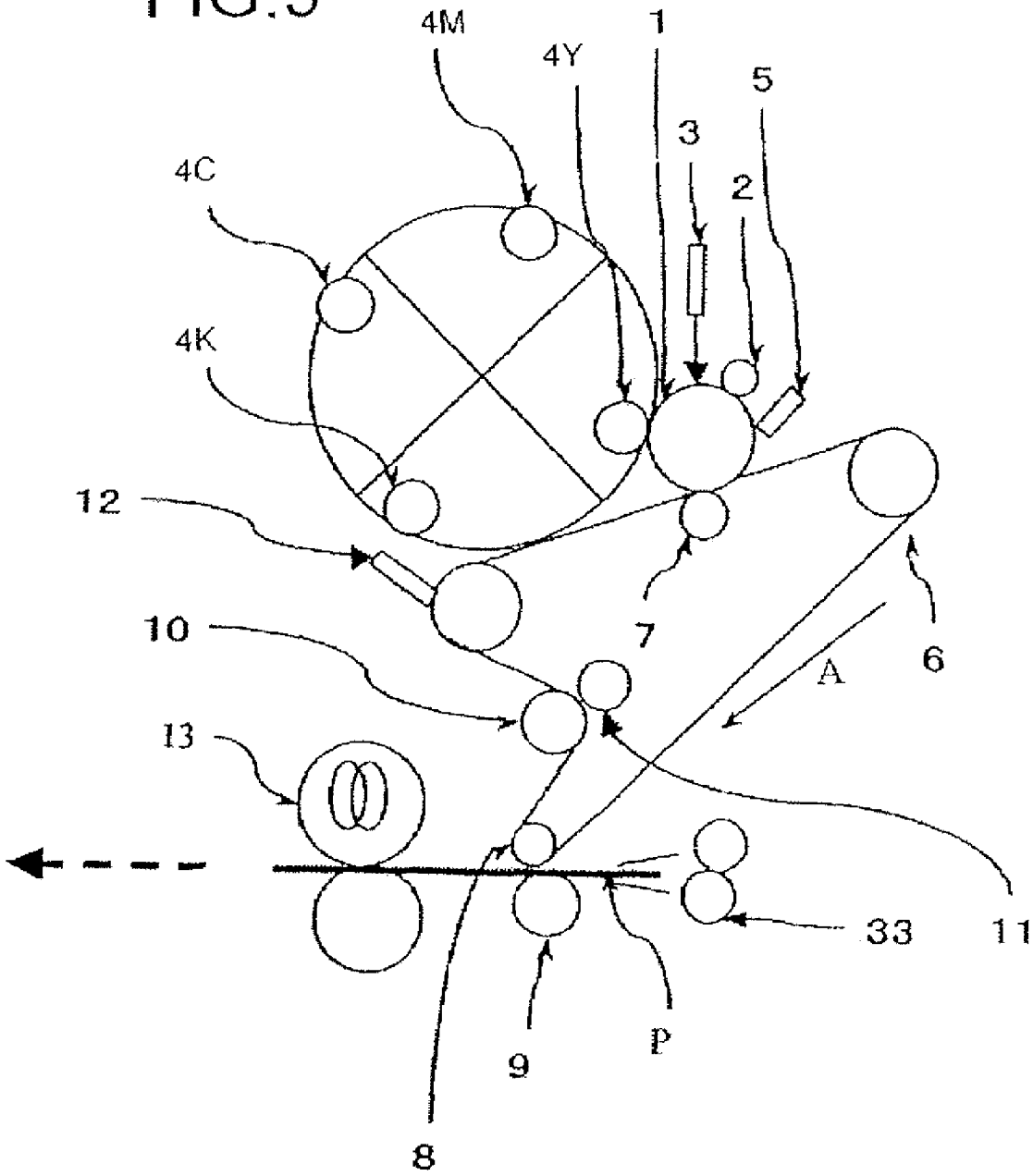
FIG. 5 is an explanatory view illustrating an image forming portion of a third embodiment of the invention.

An image forming apparatus according to a third embodiment of the invention will be described below with reference to FIGS. 5 to 7. Only the characteristic configuration of the image forming apparatus of the third embodiment will be described, and the overlapping description will not be repeated because the basic configuration of the second embodiment is similar to that of the first embodiment. In the third embodiment, the components having the same function as that of the above embodiments is designated by the same reference numerals and characters.

The third embodiment is a four-cycle process in which a full color image is formed with one photosensitive drum 1. That is, the development devices are exchanged in each time one-color developer image is primary-transferred, and the multi-color image obtained by repeating the primary transfer of the developer image in each turn of the intermediate transfer belt 6.

In repeating the four-color primary transfer, as shown in FIG. 6, the secondary transfer roller 9 and the intermediate transfer member cleaning device 12 are separated from the intermediate transfer belt 6 by a cam. In secondary-transferring the developer image of the intermediate transfer belt 6, as illustrated in FIG. 5, the secondary transfer roller 9 and the intermediate transfer member cleaning device 12 are pressed against the intermediate transfer belt 6 to clean the secondary transfer roller 9 and the intermediate transfer belt 6.

In the third embodiment, the interval L illustrated in FIG. 6 in the range of the secondary transfer portion to the reverse bending portion is set to 30 mm, and the intermediate transfer belt 6 is separated from the fixing device 13 by the reverse bending portion such that the heat of the fixing device 13 has a little influence on the intermediate transfer belt 6.

Because the intermediate transfer belt 6 has a thickness of 200 μm and a volume resistivity of $5\times10^{8}$ Ω·cm, the electrical resistance in the thickness direction becomes about $1\times10^{7}$Ω in the secondary transfer portion, and the electrical resistance becomes about $2.5\times10^{9}$Ω between the secondary transfer portion and the reverse bending portion, which is 150 times the electrical resistance in the thickness direction.

In the secondary transfer portion of the third embodiment, the backup roller power supply 50*a* which applies the negative high voltage having the same polarity as the developer charge polarity is connected to the backup roller 8, and the transfer bias of −1500V is applied to the backup roller 8 while the secondary transfer roller 9 is grounded. On the other hand, in the reverse bending portion, the reverse bending roller power supply 40*a* which applies the negative high voltage having the same polarity as the transfer bias is connected to the reverse bending roller 10, and the developer adhesion preventing bias of −1500V is applied to the reverse bending roller 10. The electrode roller 11 is caused to abut on the nip region shown by broken lines of FIG. 6 where the reverse bending roller 10 comes into contact with the intermediate transfer belt 6, and the electrode roller 11 is grounded. The developer adhesion preventing bias is continuously applied while the primary transfer is repeated.

In the third embodiment, the secondary transfer current of 22 μA is passed through the backup roller 8, and a current lower than 1 μA flows through the electrode roller 11 via the intermediate transfer belt 6.

Accordingly, in the third embodiment, the electrical interference caused by the bias application is decreased between the secondary transfer portion and the reverse bending portion while transfer residual developer is prevented from adhering to the reverse bending roller 10, which allows the output image to be stably obtained.

COMPARATIVE EXAMPLE 2

Figure 7:
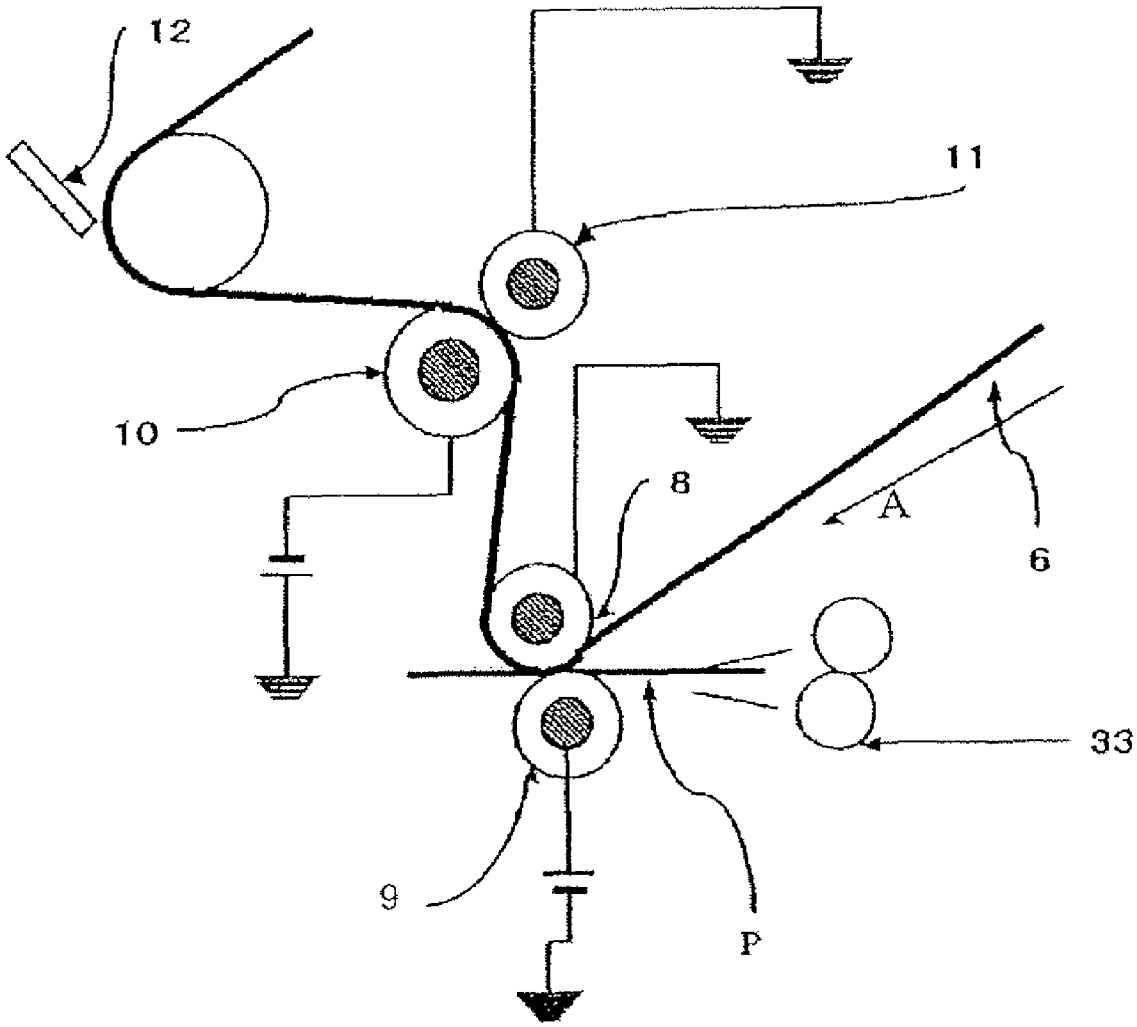
FIG. 7 is an explanatory view of a comparative example.

FIG. 7 shows a configuration of a comparative example 2. The backup roller 8 is grounded, a power supply which applies the positive high voltage is connected to the secondary transfer roller 9, and the transfer bias of +1500V is applied to the secondary transfer roller 9. In the reverse bending portion, a power supply which applies a negative high voltage having the polarity opposite to the transfer bias polarity is connected to the reverse bending roller 10, and the developer adhesion preventing bias of −1500V is applied to the reverse bending roller 10 while the electrode roller 11 is grounded.

In the comparative example 2, a secondary transfer current of about 19 μA is passed through the backup roller 8, and a current of 3 μA is passed through the electrode roller 11 via the intermediate transfer belt 6.

Image Evaluation Between Embodiment and Comparative Example

In the image formation of each embodiment, two-color solid filled developers are formed on the intermediate transfer belt 6, the transfer bias and the developer adhesion preventing bias are applied to transfer the developers to the recording medium P, and the output image and the dirt of the reverse bending roller 10 are evaluated.

As a result of the evaluation, in the comparative examples, when the developer adhesion preventing bias is applied, the defective transfer is generated. On the contrary, in the above-described embodiments, even if the developer adhesion preventing bias is applied the defective transfer is not generated in the output image. Staining caused by the developer adhesion is not observed when the visual inspection is performed to the reverse bending roller 10 after image formation.

In the third embodiment, during the primary transfer, the developer image does not adhere to the reverse bending roller 10 nor is the developer image disturbed on the intermediate transfer belt 6.

This application claims the benefit of priority from the prior Japanese Patent Application No. 2006-015733 filed on Jan. 25, 2006, the entire contents of which are incorporated by reference herein.

What is claimed is:

1. An image forming apparatus comprising:

a rotatable belt member for bearing a toner image;

a first transfer member, which is grounded and abuts an outer peripheral surface of the belt member;

a second transfer member, which abuts an inner peripheral surface of the belt member and presses the first transfer member through the belt member so as to form a transfer portion, where a toner image borne on the belt member is transferred to a transfer material;

a first voltage output portion, which applies a voltage having a same polarity as the toner to the second transfer member;

a first bending member, which is arranged downstream of the transfer portion in a rotating direction of the belt member, abuts the outer peripheral surface of the belt member and bends the belt member toward the inner peripheral surface of the belt member;

a second bending member, which is grounded, abuts the inner peripheral surface of the belt member and presses the first bending member through the belt member; and a second voltage output portion, which applies a voltage having a same polarity as the toner to the first bending member.

2. The image forming apparatus according to claim 1, comprising a cleaning unit, which cleans toner remaining on the belt member after the toner image is transferred, wherein the cleaning unit is arranged downstream of a bending portion formed by the first bending member in a rotating direction of the belt member.

3. The image forming apparatus according to claim 1, wherein the belt member has a volume resistivity ranging from $1\times10^{5}$ Ω·cm to $1\times10^{13}$ Ω·cm and a surface resistivity ranging from $1\times10^{7}$Ω/□ to $1\times10^{15}$Ω/□.

4. The image forming apparatus according to claim 1, wherein the first and second bending members are conductive rollers.

5. The image forming apparatus according to claim 1, wherein a non-supported interval of the belt between the transfer portion of the belt and a bending portion of the belt, formed by the first bending member, is 200 mm or less.

6. The image forming apparatus according to claim 1, wherein the electric resistance of the belt member in the belt thickness direction is smaller than the electric resistance of the belt member along the distance of the belt between the transfer portion of the belt to the bending portion of the belt, formed by the first bending member.

7. The image forming apparatus according to claim 1, further comprising:

a image forming portion, which has an image bearing member and forms the toner image on the image bearing member; and a primary transfer roller, which transfers the toner image borne on the image bearing member to the belt member.

8. An image forming apparatus comprising:

a rotatable belt member bearing a toner image;

a first transfer member, which abuts an outer peripheral surface of the belt member;

a second transfer member, which is grounded and abuts an inner peripheral surface of the belt member and presses the first transfer member through the belt member so as to form a transfer portion, where a toner image borne on the belt member is transferred to a transfer material;

a first voltage output portion, which applies a voltage having a polarity opposite to the toner to the first transfer member;

a first bending member, which is arranged downstream of the transfer portion in a rotating direction of the belt member, is grounded, abuts the outer peripheral surface of the belt member and bends the belt member toward the inner peripheral surface of the belt member;

a second bending member, which abuts the inner peripheral surface of the belt member and presses the first bending member through the belt member; and a second voltage output portion, which applies a voltage having a polarity opposite to the toner to the second bending member.

9. The image forming apparatus according to claim 8, further comprising a cleaning unit, which cleans toner remaining on the belt member after the toner image is transferred, wherein the cleaning unit is arranged downstream of a bending portion of the belt, formed by the first bending member in a rotating direction of the belt member.

10. The image forming apparatus according to claim 8, wherein the belt member has a volume resistivity ranging from $1\times10^{5}$ Ω·cm to $1\times10^{13}$ Ω·cm and a surface resistivity ranging from $1\times10^{7}$Ω/□ to $1\times10^{15}$Ω/□.

11. The image forming apparatus according to claim 8, wherein the first and second bending members are conductive rollers.

12. The image forming apparatus according to claim 8, wherein a non-supported interval of the belt between the transfer portion of the belt and a bending portion of the belt, formed by the first bending member, to 200 mm or less.

13. The image forming apparatus according to claim 8, wherein the electric resistance of the belt member in the belt thickness direction is smaller than the electric resistance of the belt member along the distance of the belt between the transfer portion of the belt to a bending portion of the belt, formed by the first bending member.

14. The image forming apparatus according to claim 8, further comprising:

a image forming portion which has a image bearing member and forms a toner image on the image bearing member; and a primary transfer roller, which transfers which transfer the toner image on the image bearing member to the belt member.

* * * * *